US005191718A

United States Patent [19]

Fox

[11] Patent Number: 5,191,718

[45] Date of Patent: Mar. 9, 1993

[54] MASONRY BLOCK SPACER TOOL

[75] Inventor: Robert E. Fox, St. Clair Shores, Mich.

[73] Assignee: Trend Products Inc., Warren, Mich.

[21] Appl. No.: 862,723

[22] Filed: Apr. 3, 1992

[51] Int. Cl.[5] ..... G01B 3/30; G01B 5/14; F04G 21/18; F04G 17/075

[52] U.S. Cl. ..... 33/526; 33/518; 52/509; 52/712; 249/214

[58] Field of Search ..... 33/526, 518, 613, 626, 33/645; 24/546, 533; 52/308, 379, 383, 509, 518, 562, 477, 712, 747, 98; 249/214

[56] References Cited

U.S. PATENT DOCUMENTS

| | | | |
|---|---|---|---|
| 1,293,391 | 2/1919 | Ewing | 249/214 |
| 1,765,664 | 6/1930 | Flath | 52/712 |
| 2,227,842 | 1/1941 | Polivka | 52/509 |
| 2,797,495 | 7/1957 | Walston | 33/518 |
| 2,930,135 | 3/1960 | Rodtz . | |
| 3,010,213 | 11/1961 | Rodtz . | |
| 3,199,205 | 8/1965 | Halde et al. | 33/526 |
| 3,290,712 | 12/1966 | Richey | 33/518 |
| 3,396,936 | 8/1968 | Bowden | 249/214 |
| 3,735,497 | 5/1973 | Boettcher . | |
| 4,054,258 | 10/1977 | Holmboe | 249/214 |
| 4,062,514 | 12/1977 | Scott-King | 249/214 |
| 4,114,337 | 9/1978 | Neuhardt . | |
| 4,239,173 | 12/1980 | Sawyer | 249/214 |
| 4,277,927 | 7/1981 | Richter . | |
| 4,408,398 | 10/1983 | Glaze . | |
| 4,774,793 | 10/1988 | Mayer . | |
| 4,793,068 | 12/1988 | Golkar | 33/526 |
| 4,889,310 | 12/1989 | Boeshart | 52/564 |
| 4,959,937 | 10/1990 | Mayer | 52/509 |
| 5,031,372 | 7/1991 | McCluer | 52/308 |
| 5,119,567 | 6/1992 | Fox | 33/526 |

OTHER PUBLICATIONS

Pittsburgh Corning, "PC Glass Block Spacers" Data Sheet Nov. 1988 (Referencing U.S. Pat. No. 4,114,337).

*Primary Examiner*—William A. Cuchlinski, Jr.
*Assistant Examiner*—C. W. Fulton
*Attorney, Agent, or Firm*—Myers, Liniak & Berenato

[57] ABSTRACT

A masonry block spacer tool includes two opposing base plates each having four pins for nesting the corners of masonry blocks therein as the blocks are being assembled into a wall or panel, and a cross-member between the plates whose ends snap fit into the base plates and form one of the four pins.

12 Claims, 2 Drawing Sheets

MASONRY BLOCK SPACER TOOL

FIELD OF THE INVENTION

This invention relates to spacer tools for properly aligning masonry blocks as they are being assembled into a wall or panel.

BACKGROUND OF THE INVENTION

Structural or architectural walls and panels are often formed of blocks of various types. These blocks may be referred to generically as "masonry blocks" and include such items as bricks, glass blocks, cinder blocks, tiles and the like.

The walls so formed from these masonry blocks may be curved or straight. In either instance, particularly where mortar is applied between the blocks as they are being assembled in stacked rows, a significant level of skill is required to properly space and align the blocks with respect to each other. Without the aid of various tools, including spacers, considerable time may be consumed in building the intended structure. Certain previously employed spacers, furthermore, have not always achieved their full intended purpose. For example, they may be unduly complex or time consuming to install, too insecure to establish consistent spacing, too disruptive of the mortar so as to require undue finishing time, too costly, and/or non-removable, thereby preventing the wall from having an Underwritten Laboratory fire rating approval.

Exemplary of known tools for use in building walls of masonry block and various other uses, are the devices disclosed in the following prior art references:

| | | |
|---|---|---|
| U.S. Pat. No.: | 4,114,337 | 3,396,936 |
| | 4,774,793 | 4,239,173 |
| | 4,408,398 | 3,199,205 |
| | 2,797,495 | 2,227,842 |
| | 3,290,712 | 4,054,258 |
| | 4,793,068 | 3,735,497 |
| | 4,959,937 | 3,010,213 |
| | 1,293,391 | 4,277,927 |
| | 1,765,664 | 2,930,135 |

Attention is also directed to Pittsburgh Corning, "PC Glass Block Spacers" Data Sheet 11/88 referencing U.S. Pat. No. 4,114,337.

One prior art spacer tool which has been found particularly advantageous for use in building structural panels or walls of glass block and the like is shown in FIG. 6. This tool is more fully disclosed in my co-pending application Ser. No. 07/561,195 filed Aug. 1, 1990, entitled GLASS BLOCK SPACING TOOL AND METHOD, and now U.S. Pat. No. 5,119,567. The disclosure of this co-pending application is incorporated herein by reference.

The preferred embodiment of my previous spacer, as shown in the drawings of, and as described in, the aforesaid co-pending application (and with reference to FIG. 6 herein) includes a pair of opposing plate-like base members (A, A') having opposite, opposing faces. Projecting inwardly from base members A, A' are four pin-like projections B (only 3 shown for each plate-like base member). These projections are arranged so that they project into the mortar C between the blocks D without displacing any significant portion of the mortar thus requiring, at worst, only very simple and quick finishing after the spacer is removed.

Extending between each base member A, A', there is a wire cross-member E which is sufficiently thin so as not to displace a significant portion of the mortar. This wire cross-member E extends through apertures F, F' located in the lower half and horizontal center of each of the base members A, A'. By bending wire E after installation the base members A, A' are tightly secured together. Apertures F, F' serve as convenient handles for removing the spacer tool after breaking off the end of wire E.

My aforesaid co-pending application also disclosed a unique prior art method for using the spacer disclosed therein for laying up a block wall. Generally speaking, this method included applying wet mortar to the upwardly facing and vertical edges of a first course of blocks, assembling a pair of the opposing plate with its cross-member, pressing the assembly into the wet applied mortar so as to locate one of the four pin-like projections and the cross-member in the mortar of a vertical joint between the blocks and so that two of the four pin-like projections were pressed into the wet mortar located on the upwardly facing horizontal edges of the blocks, and so that the remaining pin-like projection was spaced above the course for horizontally spacing apart blocks in the next course to be laid.

In this configuration the cross-member wire after crimping cooperated to hold the system in proper spatial alignment while a second course of blocks on the mortar-coated edges was laid on the first course. By repeating this operation until the wall was complete, proper spatial alignment in the entire wall was achieved. Then, before the mortar set, the spacers including, if desired, the cross-member, was removed with minimal dislocation of mortar. Simple tooling of the mortar joints smoothed out any impressions left by the four pin-like projections and/or the thin wire cross-member.

In certain forms of my above-described prior art spacer tool I also provided means for making curved surfaces. This included using the aforesaid spacer tool in association with sleeves inserted over opposite pairs of the spacer pins of the spacers. This achieved, in a given sleeved spacer, the presentation of the pins in a greater diameter than those of the opposing spacer. Accordingly, curvature was accomplished. For example, by providing sleeves on one side of the wall on the two vertically aligned pins, the wall can be caused to curve about a vertical axis. By using a sleeve on the two horizontally aligned pins, the wall is curved about a horizontal axis.

My above-described prior art spacer tool constituted a significant and advantageous improvement in the art. However, further improvement is virtually always possible in any field of endeavor and that has turned out to be true here. For example, while the use of a crimpable wire as the cross-member in my prior spacer worked well if properly crimped in the field by the worker, if it prematurely broke off or was not crimped tightly enough, non-optimal cross-membering could occur. In addition, the base plates employed, in addition to four pin-like projections on one side of the plate, a separate elongated projection requiring a thin aperture hole to be formed therein to accommodate the cross-member, on the opposite side of each plate. A less complex arrangement which achieved all of the advantages of my prior spacer tool, but which overcame the problems attendant the use of a wire cross-member, would therefore be desirable. Thus, there arose a need in the art for just such a system.

It is a purpose of this invention to fulfill this and other needs in the art which will become more apparent to the skilled artisan once given the following disclosure.

SUMMARY OF THE INVENTION

Generally speaking, this invention fulfills the above-described needs in the art by providing in a masonry block spacer tool for holding glass blocks in proper alignment during construction of a panel or wall being formed of such blocks, the spacing between the blocks being fillable with mortar and the tool including a pair of opposing plate-like base members having opposite, opposing faces, a plurality of pin-like projections extending from each said opposing face toward the other opposing face of the other plate-like base member, the pin-like projections being so arranged on each of the opposing plate-like base members and of such a size and location so as to project into the spacing fillable with the mortar, but not to displace any significant portion of the mortar if, and when, the spacing in which said pin-like projection resides is filled with said mortar, and so as to receive and retain opposing corner surfaces of the blocks, each pin-like projection extending from one of the opposing faces having a substantially co-axially aligned corresponding pin-like projection extending from the other opposing face, thereby to properly space and align the block with respect to each other, and means for firmly securing he spacing and alignment of the blocks which includes for each pair of opposing plate-like base members, a cross-member means sufficiently thin so as not to displace a significant portion of said mortar if, and when, the spacing in which it resides is filled with said mortar, and aperture means located in one half and approximate horizontal center of each of said opposing faces and aligned with the other, the cross-member means being fastenable in the aperture means thereby to tightly secure the spacing and alignment of the blocks, the improvement comprising, as the cross-member means an integral elongated member having at each of its ends means for securing the cross-member in the aperture means, the member extending inwardly therefrom and through the aperture means thereby to form one of the pin-like projections extending from each opposing face toward the other opposing face of the other plate-like base member.

In certain preferred embodiments the aperture means includes a substantially rectangular open-ended slot in one side of the base members. The cross-member is then provided at its end portions with corresponding lateral grooves which are slightly greater in width than the thickness of the base member. The cross-member's ends, in this way, may be slidably engaged or press fit into the open-ended slot of the base member, tightly securing the two base members together at a predesigned spaced distance not subject to field application error.

In certain preferred embodiments for carrying out this invention, the tool is so designed to be used to accurately space blocks in a wall or panel by initially building a first course of blocks wherein two blocks are first crudely placed side-by-side and the vertical joint between them is substantially completely filled with mortar. Mortar is also applied to the top horizontal surfaces of the blocks to seal the horizontal joint with the next course if one is to be constructed. The tool is then installed by pushing it into the mortar until the pins and cross-member are properly located. This is then followed by final adjustment of the spacing of the blocks. This operation is repeated from course to course until the wall or panel is constructed. The tool is then removed before the mortar sets up.

If the tool is one in which the cross-member is not preassembled by non-removable press fit at the factory, it may be removed by disassembling it and can be reused if desired. If the tool is preassembled by a strong press fit at the factory, disassembly may be accomplished by breaking off one base member from the cross-member and disposing of the tool. Because of the simplicity of this latter type of tool and its corresponding relatively low cost, the disposable nature of this non-reusable embodiment actually turns out to be advantageous in a number of situations.

This invention will now be described with respect to certain embodiments thereof as illustrated in the following drawings, wherein:

IN THE DRAWINGS

FIG. 1 is a perspective view of two courses of a glass block wall in which the spacing tools of this invention have been installed in both the horizontal and vertical directions;

FIG. 2 is a perspective, exploded view of an embodiment of this invention;

FIG. 3 is a partial, front perspective view of an aperture means as contemplated by this invention;

FIG. 4 is a side elevational view of an embodiment of this invention as installed in the mortar filled joints between for masonry blocks;

FIG. 5 is a cross-sectional view taken along line 5—5 of FIG. 4;

FIG. 6 is a side-sectional view of my former, PRIOR ART spacer as described above and as more fully described in my aforesaid co-pending application incorporated herein by reference; and FIG. 7 is a partial top view of an embodiment of this invention used for forming curved walls.

FIG. 8 is a partial top, partial sectional view of another embodiment of this invention used for forming curved walls.

BRIEF DESCRIPTION OF THE DRAWINGS

Attention is now directed to FIG. 1 of the drawings. In this figure there is illustrated a portion of a typical masonry block wall or panel 1. Wall or panel 1 is formed of a series of courses (only two shown here) of individual blocks 3. In this case, blocks 3 are conventional glass blocks, but in other embodiments could be other types of masonry blocks such as cinder blocks, bricks, tiles or the like.

Blocks 3 in this embodiment form a straight structure, as opposed to a curved structure. For this reason, spacer tools in accordance with this invention are employed as illustrated in FIG. 1. For convenience, mortar, which normally would fill the joints between blocks 3, is not shown, to give a better picture of how the spacer tools of this invention hold and retain blocks 3 in proper alignment. It is understood, therefore, that in the preferred embodiments of this invention vertical joints 5 and horizontal joint 7 would be filled with mortar.

Figure 2:
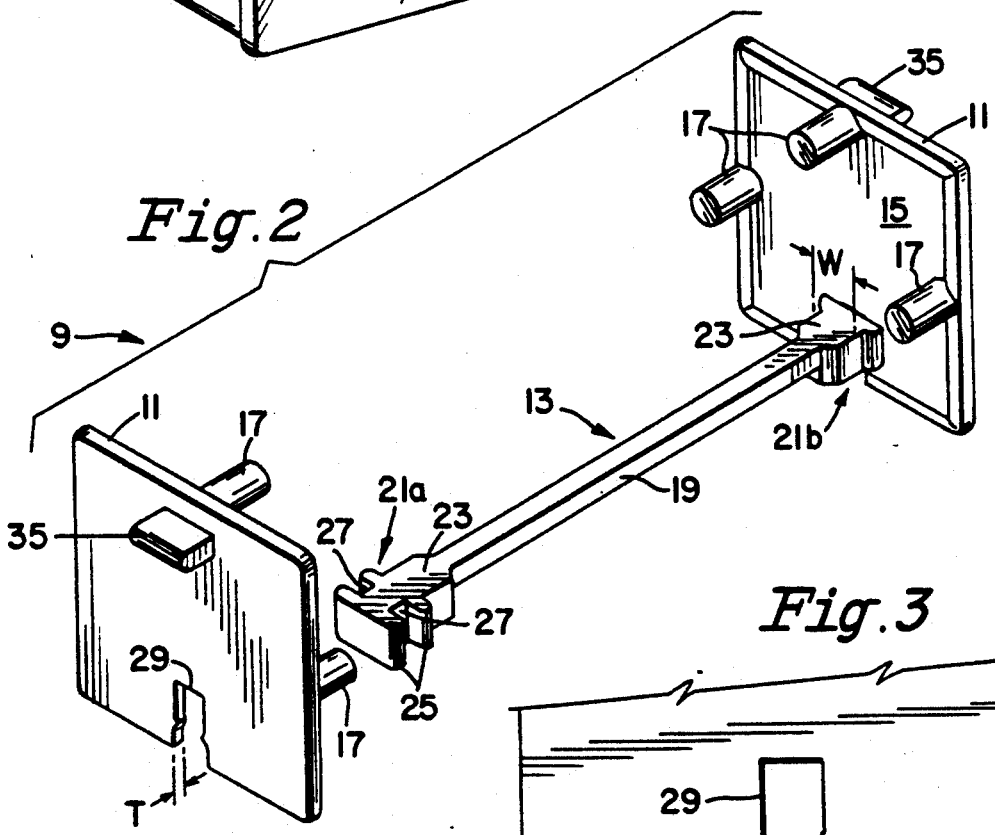

With reference now to FIG. 2, an embodiment of the unique masonry block spacer tools according to this invention is better illustrated. Therein tool 9 includes a pair of opposing base plate-like base members 11 and a cross-member 13. Plate-like base members 11 are provided on their inner wall 15 with three pin-like projections 17, such that each opposing plate-like base member 11 has three co-axially aligned pin-like projections 17 extending inwardly when cross-member 13 is in plate.

Figure 1:
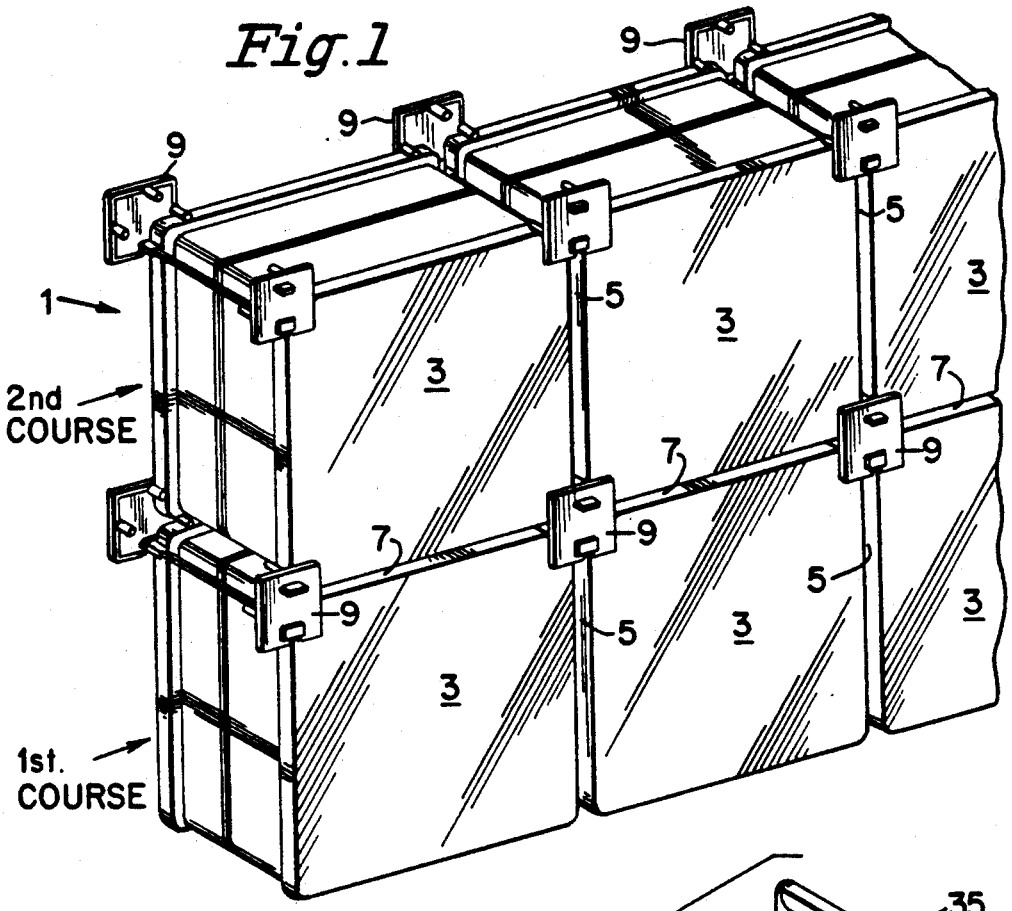

Cross-member 13 is comprised of a thin, middle shaft portion 19 and two end portions 21*a* and 21*b*. As can be seen in FIG. 2, end portions 21*a* and 21*b* are enlarged compared to the relatively thin mid-portion 19 and in the embodiment shown are of approximately the same width dimension as pin-like projections 17. In this respect, and in order that the tool not displace a significant amount of mortar after insertion therein, the size of end portions 21*a* and 21*b*, as well as pin-like projections 17 are kept to a minimum. For example, in the embodiment shown wherein the masonry blocks are conventional glass blocks, the pin-like projections 17 may be of a diameter of approximately 0.25 inches, while the rectangular, forwardmost portion 23 of ends 21*a* and 21*b* may be substantially square, each side being approximately 0.25 inches so as to approximate the same size as pins 17. Using dimensions such as this, herein the overall height and width of the substantially square plate-like base member 11 is approximately 1.5 inches, and by locating pin-like projections 17 and cross-member 13, as illustrated, at the mid-portion of each of the top, two side edges and bottom edge of plate-like base member 11, respectively , an excellent, stable, spacer tool is provided with the minimal amount of disruption to the mortar between joints 5 and 7. In this respect, of course, it is understood that he diameter of pin-like projections 17 and the width of end portions 21*a* and 21*b* are chosen so as to be of a dimension such that it achieves the desired amount of uniform spacing between blocks 3 as they are joined together as illustrated in FIG. 1.

At the terminal ends of cross-member 13 there are provided means for securely attaching the cross-member 13 to each of the opposing plate-like base members 11. As can be seen, such attaching means includes two laterally extending enlarged flanges 25 which, being spaced apart, define therebetween a pair of opposing grooves 27. Groove 27 is formed so as to be of a width just slightly larger than the thickness T of inner walls 15. Thus, as illustrated in FIG. 2 at 21*b*, the ends of cross-member 13 may be negated with walls 1 by sliding base member 11 into grooves 27 via the generally rectangularly shaped aperture 29 (see also FIG. 3) centrally located in the bottom edge of base member 1.

Figure 3:
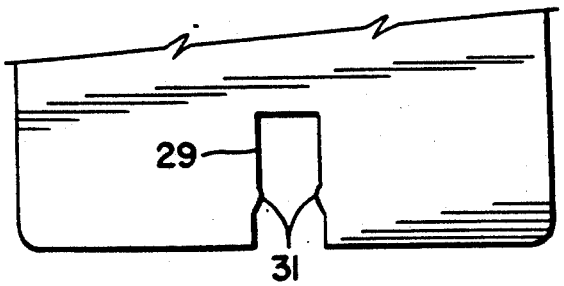

As best illustrated in FIG. 3, substantially rectangular shaped aperture 29 is provided with a pair of opposing lands 31 which are located at a distance from the top edge of aperture 29, so that this distance is only slightly greater than the height (e.g. 0.25 inches) of cross-member 13. In this way, when cross-member 13 via its grooves 27 is slid upwardly into aperture 29, end portions 21*a* and 21*b* of cross-member 13 snap-fit into and slightly above lands 31 (see FIG. 4). Lands 31 thereby tightly hold cross-member 13 in aperture 29 during construction of wall 1.

It is understood, in this respect, that cross-member 13, including its end portions, will be of a precise length so as to be matched with the width of the masonry block 3 being employed. Since such blocks are standard in width, then spacer tool 9 for each job will be, by specification, of the exact length for that particular job. In this way, it can either be left to the mason building the wall 1 to assemble tool 9 at the job site, or, if desired, tool 9 can be preassembled at the manufacturing site without concern, as in the past, that the mason may not achieve optimal tightness or alignment because wire crimping has now been eliminated.

While this invention contemplates allowing a mason to assemble the tool at the job site, other embodiments envision the use of preassembled parts. The advantage of preassembly at the factory can, in certain instances, be of significant benefit, particularly for example, in cold weather where the mason's hands may be cold or stiff, making it difficult for him to assemble small items together. In this embodiment, if desired, fitment between aperture 29 and groove 27 can be made so tight that it requires a press fit by mechanical means at the factor to insert the ends of cross-member 13 into apertures 29. In this way, assurance is presented on the job site that all joints will have employed in them two opposing plate-like base members 11, rather than having any left out because of dislodgement or human error. However, in such situations, it is then understood that tool 9 will not be reusable as hereinafter described more fully.

One of the significant advantages of the subject invention is that the parts shown for tool 9 may be conveniently made of plastic by injection molding or other known plastic molding techniques and all parts may be made, in this respect, of the same plastic to simplify inventory accounting. The plastic, or any other material used, should be chosen for its requisite strength and non-reactivity to the mortar that is going to be used. A particularly preferred material for the purposes of this invention is high impact ABS plastic such as is sold by Mayco Plastics Inc. of Utica, Mich. High impact ABS is reported in various technical literature as being acrylonitrile butadiene styrene having a specific gravity of approximately 1.04–1.06 and a flammability (in./min.) of approximately 1.3. The usual tensile strength (1,000 pounds per square inch) is about 4.5–8.5.

Figure 4:
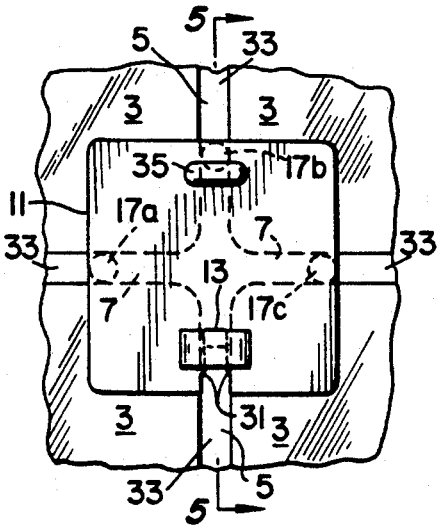
Figure 5:
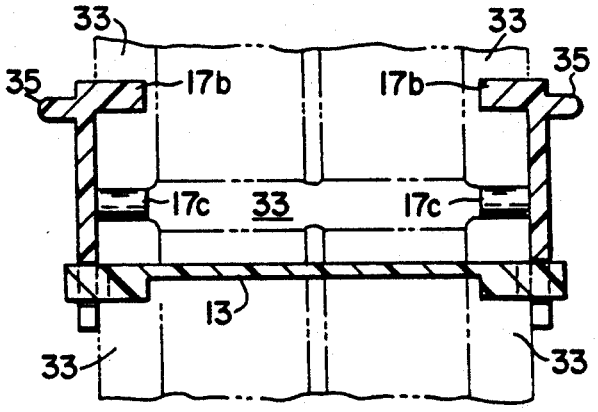
Figure 6:
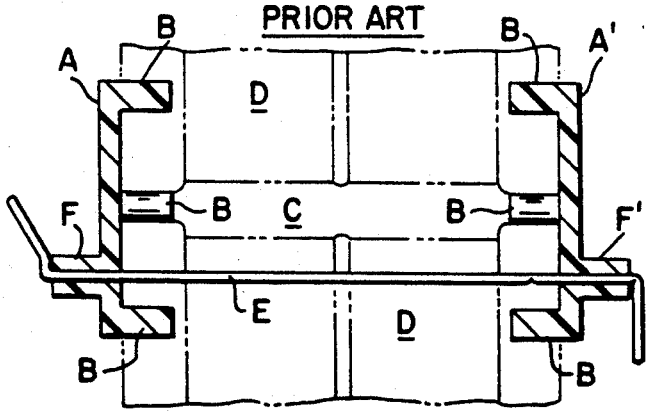
Fig. 6 PRIOR ART

With reference now to FIGS. 4 and 5, masonry block spacer tool 9 is illustrated as being installed in a typical mortar joint between four masonry blocks 3. Blocks 3 are provided in their joints with mortar 33 into which pins 17*a*, 17*b*, 17*c* and cross-member 13 intrude. One of the unique features of this invention is the fact that a fourth pin need not be formed in base member 11 as in my previously described spacer tool device. That is because, through the uniqueness of this invention, and as illustrated in FIGS. 4 and 5, cross-member 13 takes the place of what would otherwise be, of necessity, another pin. In this respect, it should be pointed out that in the embodiment shown best, for example, in FIG. 2, it is the width W of end portions 21*b* and 21*a* of cross-member 13, as well as the diameter of pin 17*b* which governs the spacing of vertical joints 5, while it is the diameter of pins 17*a* and 17*c* which govern the spacing of horizontal joints 7. Thus, it is important, that, for example, pin 17*b* be of approximately the same width as width W to maintain uniform spacing. In a like manner, pin 17*a* should be of the same diameter as pin 17*c*. Where, of course, all spacing is to be uniform as between the horizontal and vertical joints, then all three pins, as well as width W of ends 21*a* and 21*b* should be approximately equal.

Tool 9 is installed and employed in a similar fashion as was described in my aforementioned co-pending application .That is to say, in a typical operation, the first course of blocks (one by one) would normally be laid on its foundation. Mortar33 would be provided, in this respect, in each vertical joint 5 as it was formed (see FIG. 1) and the top portions of the blocks 3 would be provided with mortar. Thereafter, tool 9 would be assembled (or it may come preassembled from the factory) wherein after it would be forced down into the mortar residing in joint 5 between two blocks 3 until pins 17*a* 17*c* came to rest on the top of the blocks 3. Thereafter, the blocks would be adjusted as they were set, so as to reside against the vertical walls of the end portions 21*a* and 21*b* at width W of cross-member 13. Each successive block in the first course is similarly laid by the mason, until all vertical joints 5 in the first course of blocks are equally spaced and securely aligned. Thereafter, a second course of blocks 3 (as illustrated in FIG. 1) would be laid on top of the first course, again, with joints 5 filled with mortar and the top second block pushed down and aligned so that its bottom surface would contact pins 17*a* or 17*c* and its side edge would be spaced from its adjacent block by pin 17*b* (as shown in FIG. 4).

If these were to be the only two courses to be used in the wall or panel, the top of the second course of blocks 3 would not have provided mortar on the top thereof nor would it have any tools 9. If, however, further courses were to be laid on top of the second course (as anticipated in FIG. 1), then mortar would be applied to their top and the process as described above continued until the entire wall, or desired section thereof, is built. In this manner, then, all spacing in both the vertical joints 5 and horizontal joints 7 would be appropriately achieved, while, at the same time, wall 1 would be secured in a tight-fitting alignment because of the integral nature of tool 9. Then, prior to the full setting of mortar 33 in the joints, tool 9 is removed and by simple masonry finishing tools, the small amount of disruption of the mortar accruing from the use of tool 9 is simply eliminated by the mason.

Removal of tool 9 takes place differently if tool 9 was reusable, as opposed to where tool 9 was not to be reusable, but had been press fit by mechanical means at the factory. In the first instance, for example, where tool 9 was to be reusable, one or both of plate-like base members 11 would simply withdrawn through the mortar. To accomplish this purpose, a small handle means 35 is provided midway between the two side edges of base member 11 and near the top edge thereof. Tools 9 may then be reused in other locations on the same job site or used on other job sites.

In the case where tools 9 are not to be reused because base embers 11 are press fit in a relatively non-removable fashion because of the tightness of the fit in grooves 27 then, cross-member 13 is made of a sufficiently narrow dimension in its mid-portion 19, or notched near one of the ends of mid-portion 19 (not shown) so as to be easily broken. In this respect, then, handle 35 may simply be grasped by a pair of pliers or the like and snapped downwardly to break off one end 21*a* and 21*b* from mid-portion 19 thereby allowing simple removal of the now non-reusable tool 9, including the broken cross-member 13. Once again, however, simple masonry finishing techniques may be employed to finish off the small amount of disruption in the mortar as occasioned by tool 9.

Figure 7:
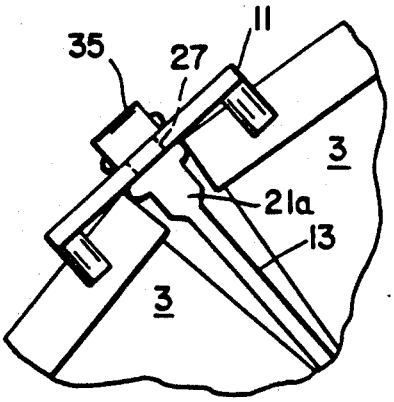

Reference is now made to FIG. 7 which illustrates one embodiment of a tool as contemplated by this invention by which curved walls or panels may be formed. In this embodiment, rather than employing a sleeve over one of the pins, as was disclosed in my prior application, inboard flange 27 at one end (but not at both ends) of cross-member 13 is made larger than its opposing end portion at the other end of cross-member 13. In the alternative, end portion 21*a* could be made larger than end portion 21*b*. In this way, the enlarged portion will define a larger spacing between opposing blocks 3 on one side of the wall than on the other. In this way, whether used in a vertical joint 5 or rotated 90° so as to e used in a horizontal joint, the requisite curve is formed either horizontally or vertically (respectively). In this respect, for convenience, in FIG. 7, the corresponding pin 17*b* has not been shown. It is, of course, understood in this regard, that a sleeve would be placed over pin 17*b* so as to be of the same dimension as flange 27 or end portion 21*a*, thereby to provide the requisite uniform spacing either in the horizontal or vertical direction as the case may be.

Figure 8:
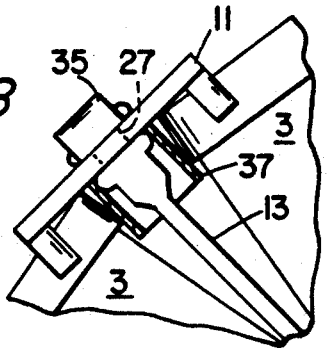

Alternatively, of course, there are other ways of creating the requisite difference in spacing between the front and back joints of a wall to crate the desired curve. One of these alternatives is shown in FIG. 8. Rather than manufacturing one inboard flange 27 and/or end portion 21*a* to be larger than its opposing inboard flange 27 on the other end of cross-member 13 and/or opposing end portion 21*b*, sleeves 37 may be provided for both pin 17*b* and flange 27 (including edge portion 21*a*) to achieve the same purpose. Such sleeves may be made out of any requisite material. High impact ABS or other plastic, for example, may be used. With the use of such sleeves 37 standardized to all pins and end portion 21*a* (and flange 27) pin 17*a* with 17*c* can be employed to give the requisite curve in either the horizontal or vertical direction or pin 17*b* with cross-member 13 may be used at the discretion of the mason. In addition, odd shapes may be formed by suing sleeves on other combinations of pins.

Once given the above disclosure many other features, modifications and improvements will become apparent to the skilled artisan. Such features, modifications and improvements are therefore to be considered a part of this invention, the scope of which is to be determined by the following claims:

I claim:

1. In a masonry block spacer tool for holding glass blocks in proper spaced alignment during construction of a panel or wall being formed of said blocks, said spacing between said blocks being fillable with mortar and said tool including a pair of opposing plate-like base members having opposite, opposing faces, a plurality of pin-like projections extending from each said opposing face toward the other opposing face of said other plate-like base member, said pin-like projections being so arranged on each of said opposing plate-like base members and of such a size and location so as to project into said spacing fillable with said mortar, but not to displace any significant portion of said mortar if, and when, said spacing is filled therewith, and so as to receive and retain opposing corner surfaces of said blocks, each said pin-like projection extending from one of said opposing faces having a substantially co-axially aligned corresponding pin-like projection extending from the other of said opposing faces, thereby to properly space and align said block with respect to each other, and means for firmly securing said spacing and alignment of said blocks which includes for each pair of said opposing plate-like base members, a cross-member means sufficiently thin so as not to displace a significant portion of said mortar if, and when, the spacing in which it resides is filled with said mortar, and aperture means located in one half and approximate horizontal center of each of said opposing faces and aligned with the other, said cross-member means being fastenable in said aperture means thereby to tightly secure said spacing and alignment of said blocks, the improvement comprising, as said cross-member means an integral elongated member having at each of its ends means for securing said member in said aperture means, said member extending inwardly therefrom and through said aperture means thereby to form one of said pin-like projections extending from each said opposing face toward the other opposing face of said other plate-like base member.

2. A masonry block tool according to claim 1 wherein said aperture means includes a substantially rectangular open-ended slot formed in one side edge of said opposing plate-like base members.

3. A masonry block tool according to claim 2 wherein said means in said elongated member for securing said member in said aperture means includes at each end of said elongated member a pair of opposing grooves so shaped and of a width such that each groove will accommodate the side walls of said rectangular slot of said aperture means when said grooves are slid into said aperture from its said open end thereby to obtain a tight fitting engagement of said elongated member and each of said opposing plate-like base member.

4. A masonry block tool according to claim 3 wherein the side walls of said rectangular slot include at least one ridge member for insuring said tight fitting engagement of said opposing plate-like base members and said elongated member.

5. A masonry block tool according to claim 3 wherein said opposing plate-like base members are substantially rectangular in shape, having a top edge, a bottom edge and two opposing side edges and wherein each base member has four pin-like projections, one pin-like projection being located at substantially the midpoint of each of said four edges and wherein one of said pin-like projections is an enlarged portion of said elongated member, said enlarged portion being proximate said grooves.

6. A masonry block tool according to claim 5 wherein said aperture means is located in substantially the midpoint of the bottom edge of each of said opposing plate-like base members.

7. A masonry block tool according to claim 6 wherein said plate-like base members each include an inboard face and an outboard face and wherein handle means for gripping said base member are provided on said outboard face.

8. A masonry block tool according to claim 7 wherein said handle means is located above said aperture means in the upper half of said base member approximately midway between said two side edges.

9. A masonry block tool according to claim 7 wherein said tool is made of plastic.

10. A masonry block tool according to claim 9 wherein said ends of said elongated member press fit into said aperture means.

11. A masonry block tool according to claim 1 wherein said spacing between said blocks is substantially completely filled with said mortar.

12. A masonry block tool according to claim 1 which further includes means for spacing adjoining blocks on one side of said wall or panel differently than on the opposite side of said wall or panel thereby to form an accurately aligned and spaced curved wall or panel.

* * * * *